US006841923B2

(12) United States Patent
Liu et al.

(10) Patent No.: US 6,841,923 B2
(45) Date of Patent: Jan. 11, 2005

(54) HIGH-BRIGHTNESS FLAT LAMP STRUCTURE

(75) Inventors: Chih Yung Liu, Hsinchu Hsuan (TW); De-An Chang, Hsinchu Hsuan (TW); Sheng-Chih Wan, Hsinchu Hsuan (TW)

(73) Assignee: Optoware Electronics Co., Ltd., Taipei (TW)

( * ) Notice: Subject to any disclaimer, the term of this patent is extended or adjusted under 35 U.S.C. 154(b) by 152 days.

(21) Appl. No.: 10/372,145

(22) Filed: Feb. 25, 2003

(65) Prior Publication Data

US 2004/0164664 A1 Aug. 26, 2004

(51) Int. Cl.[7] ..... H01J 1/62
(52) U.S. Cl. ..... 313/116; 313/495
(58) Field of Search ..... 313/495, 506, 313/112, 113, 116, 635, 422

(56) References Cited

U.S. PATENT DOCUMENTS 6,252,254 B1 * 6/2001 Soules et al. ..... 257/89

2003/0127973 A1 * 7/2003 Weaver et al. ..... 313/504

* cited by examiner

*Primary Examiner*—Vip Patel
(74) *Attorney, Agent, or Firm*—Rosenberg, Klein & Lee

(57) ABSTRACT

A high-brightness flat lamp structure comprises a reflecting plate, a plurality of UV light sources, a macromolecular polymer layer and a fluorescent powder layer. The UV light sources and the macromolecular polymer layer are sandwiched between the reflecting plate and the fluorescent powder layer. The functions of diffusing and guiding light of the macromolecular polymer layer are exploited to let UV lights emitted by the UV light sources and reflected by the reflecting plate excite the fluorescent powder layer to radiate high-brightness visible lights. Besides, macromolecular polymer and fluorescent powder can be mixed up to form a mixed layer of macromolecular polymer and fluorescent powder to let UV lights emitted by the UV light sources and reflected by the reflecting plate directly excite fluorescent powder to radiate high-brightness visible lights.

12 Claims, 2 Drawing Sheets

HIGH-BRIGHTNESS FLAT LAMP STRUCTURE

FIELD OF THE INVENTION

The present invention relates to a flat lamp and, more particularly, to a flat lamp of simple structure and easy manufacturing process, which has a uniform color temperature and a high brightness.

BACKGROUND OF THE INVENTION

A conventional cold cathode fluorescent flat lamp (CCFFL) comprises several UV lamps with fluorescent powder coated on inner walls thereof. A high voltage is applied across the electrodes thereof to generate UV lights, which illuminate the fluorescent powder to form visible lights. In a CCFFL disclosed in R.O.C. Pat. No. 495,796, after a chamber is vacuumed, noble gas and mercury vapor are filled therein, and a high voltage is then applied across the cathode and anode thereof through a circuit board to generate UV lights, which illuminate fluorescent powder coated on the inner wall of the chamber to form visible lights. However, because of residual organic solvent, the situation of burned black will occur at the electrodes of the CCFFL after a longtime use, hence seriously affecting the light emission efficiency. Therefore, how to manufacture a flat lamp, which can be used for a long time without affecting the light emission efficiency becomes a problem to be solved urgently by the display and lamp industry.

SUMMARY AND OBJECTS OF THE PRESENT INVENTION

The primary object of the present invention is to provide a high-brightness flat lamp with fluorescent powder coated at the outsides of UV lamp tubes thereof so as to avoid the situation of burned black at the electrodes of conventional CCFFL after a longtime use and thus solve the problem of low light emission efficiency.

The secondary object of the present invention is to provide a high-brightness flat lamp, wherein UV light sources can be flexibly arranged to adjust the brightness of the flat lamp.

To achieve the above objects, the present invention provides a high-brightness flat lamp structure, which comprises a reflecting plate, a plurality of UV light sources, a macromolecular polymer layer and a fluorescent powder layer. The UV light sources and the macromolecular polymer layer are sandwiched between the reflecting plate and the fluorescent powder layer. The functions of diffusing and guiding light of the macromolecular polymer layer are exploited to let UV lights emitted by the UV light sources and reflected by the reflecting plate excite the fluorescent powder layer to radiate high-brightness visible lights. Besides, the macromolecular polymer and the fluorescent powder can be mixed up to form a mixed layer of macromolecular polymer and fluorescent powder to let UV lights emitted by the UV light sources and reflected by the reflecting plate directly excite fluorescent powder to radiate high-brightness visible lights. Each of the UV light sources can be completely placed in the macromolecular polymer layer or the mixed layer of macromolecular polymer and fluorescent powder to achieve maximum light brightness. Or each of the UV light sources can be partly placed in the reflecting plate to control the light brightness thereof.

The various objects and advantages of the present invention will be more readily understood from the following detailed description when read in conjunction with the appended drawings, in which:

DETAILED DESCRIPTION OF PREFERRED EMBODIMENT

Figure 1A:
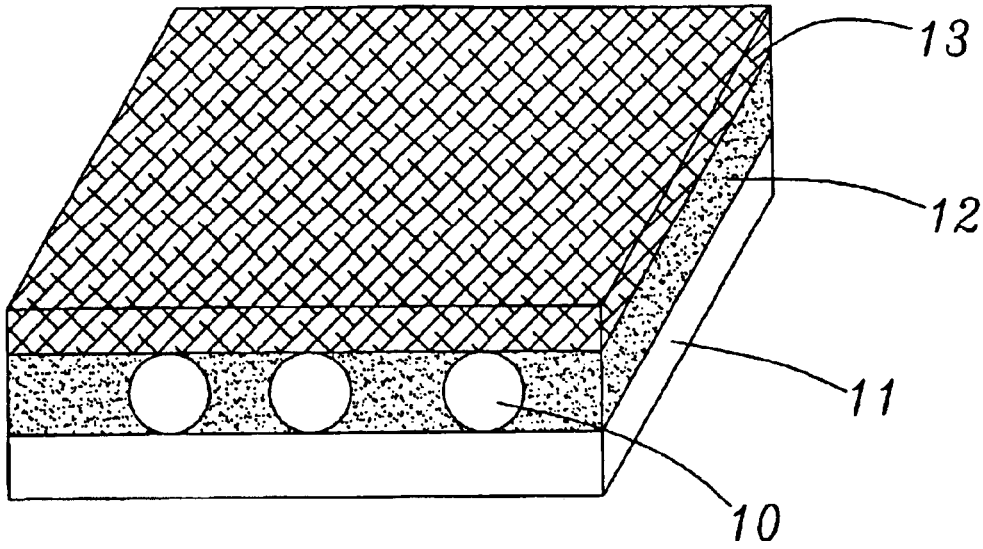
FIG. 1*a* is a perspective view of a high-brightness flat lamp according to a first embodiment of the present invention.

FIG. 1*a* is a perspective view of a high-brightness flat lamp according to a first embodiment of the present invention. A reflecting plate 11 is provided at the bottom of a lamp socket (not shown). The reflecting plate 11 is a reflecting plate capable of reflecting UV lights. Several UV light sources 10 are placed on the reflecting plate 11. The UV light sources 10 can be UV lamp tubes or UV LEDs. After a voltage is applied across the anode and cathode thereof (not shown), the UV light sources 10 will radiate UV lights in all directions. Through a macromolecular polymer layer 12 coated at the outside thereof and having the functions of diffusing and guiding light, the UV lights are uniformly incident to a fluorescent powder layer 13 coated on the macromolecular polymer layer 12 and the reflecting plate 11. Therefore, the fluorescent powder layer 13 is not only illuminated by UV lights directly emitted by the UV light sources 10 but also illuminated by UV lights reflected by the reflecting plate 11, hence forming a high-brightness flat visible light source.

Figure 1B:
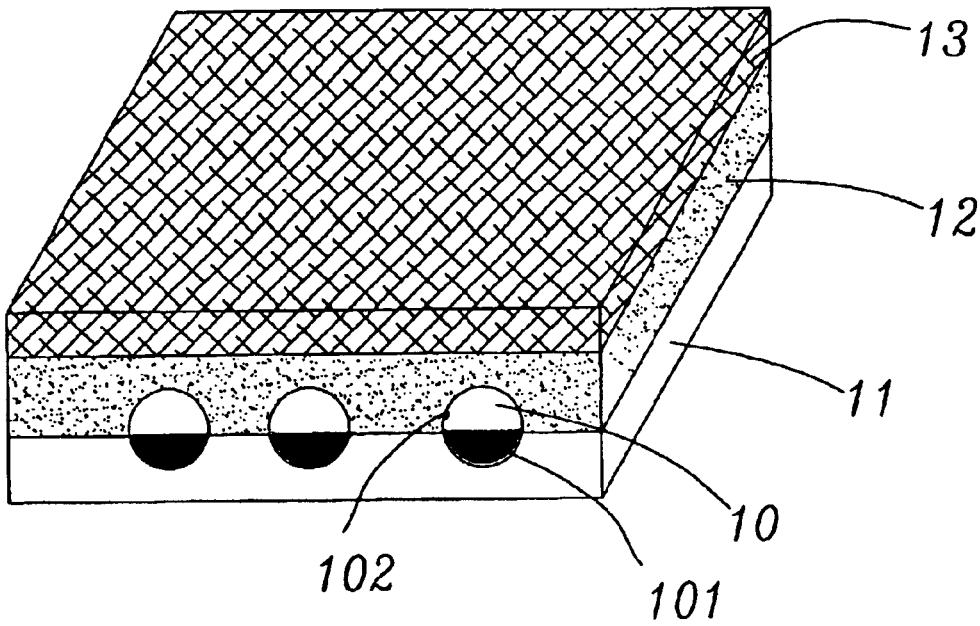
FIG. 1*b* is a perspective view of a high-brightness flat lamp according to a second embodiment of the present invention.

FIG. 1*b* is a perspective view of a high-brightness flat lamp according to a second embodiment of the present invention. Compared to the first embodiment, the second embodiment differs in that each of the UV light sources 10 is partly embedded in a groove (not shown) of the reflecting plate 11. UV lights emitted by lower half UV light sources 101 embedded in the grooves will be blocked. Only UV lights emitted by upper half UV light sources 102 can directly illuminate the fluorescent powder layer 13 or indirectly illuminate the fluorescent powder layer 13 via the reflecting plate 11. Therefore, through adjusting the embedded depth of the UV light sources 10 in the grooves of the reflecting plate 11, the brightness of visible lights radiated by the flat lamp can be determined.

Figure 2A:
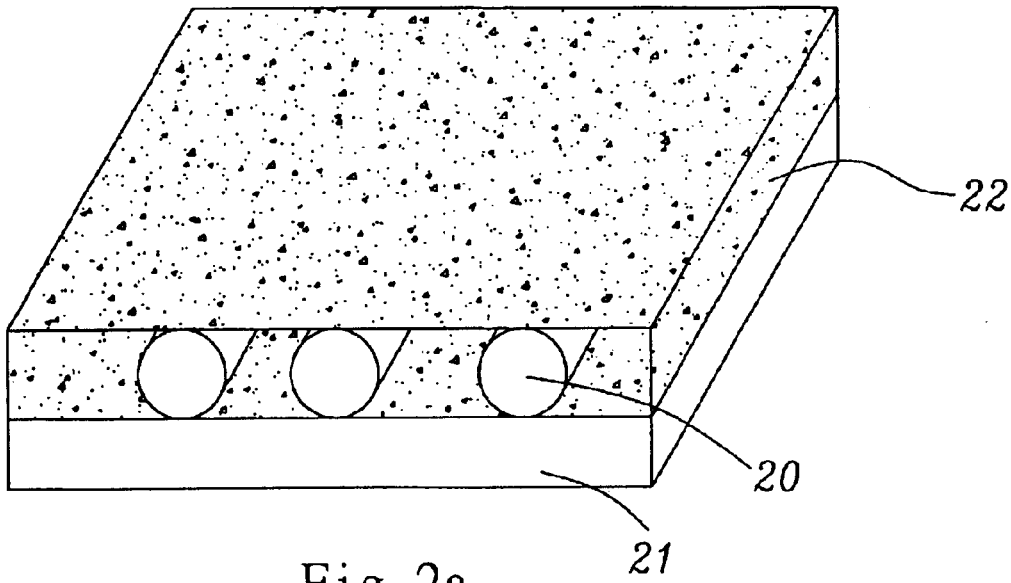
FIG. 2*a* is a perspective view of a high-brightness flat lamp according to a third embodiment of the present invention.

FIG. 2*a* is a perspective view of a high-brightness flat lamp according to a third embodiment of the present invention. Compared with the first embodiment, the third embodiment differs in that macromolecular polymer and fluorescent powder are mixed up. UV lights emitted by UV light sources 20 and UV lights reflected by a reflecting plate 21 will illuminate fluorescent powder in a mixed layer 22 of macromolecular polymer and fluorescent powder to radiate visible lights. Through macromolecular polymer having the functions of diffusing and guiding light in the mixed layer 22 of macromolecular polymer and fluorescent powder, visible lights of uniform color temperature and high brightness can be radiated.

Figure 2B:
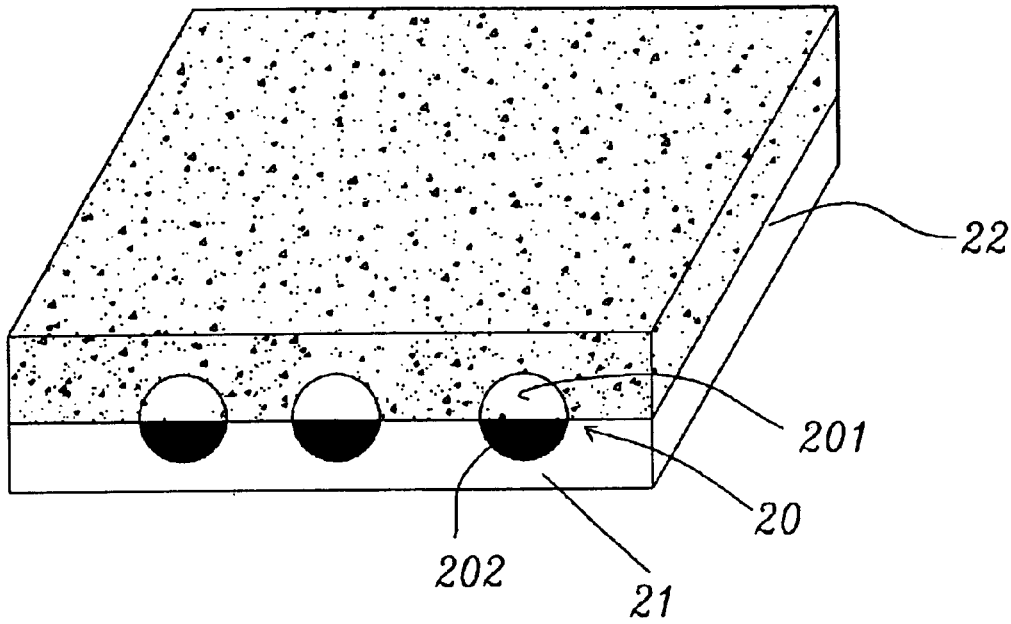
FIG. 2*b* is a perspective view of a high-brightness flat lamp according to a fourth embodiment of the present invention.

FIG. 2*b* is a perspective view of a high-brightness flat lamp according to a fourth embodiment of the present invention. Compared to the third embodiment, the fourth embodiment differs in that each lower half UV light source 202 is partly embedded in a groove (not shown) of the reflecting plate 21. Similar to the second embodiment, only UV lights emitted by upper half UV light sources 202 can directly illuminate fluorescent powder or indirectly illuminate fluorescent powder via the reflecting plate 11. Therefore, through adjusting the embedded depth of UV light sources 20 in the grooves of the reflecting plate 21, the brightness of visible lights radiated by the flat lamp can be determined.

To sum up, in the present invention, fluorescent powder is coated at the outsides of UV light sources to avoid the situation of burned black at the electrodes of conventional CCFFLs after a longtime use and thus enhance the light emission efficiency. Moreover, through adjusting the embedded depth of the UV light sources in the reflecting plate, the brightness of visible lights radiated by the flat lamp can be adjusted.

Although the present invention has been described with reference to the preferred embodiments thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A high-brightness flat lamp structure having a reflecting plate, a plurality of UV light sources, a macromolecular polymer layer and a fluorescent powder layer, said UV light sources and said macromolecular polymer layer being sandwiched between said reflecting plate and said fluorescent powder layer, the functions of diffusing and guiding light of said macromolecular polymer layer being exploited to let UV lights emitted by said UV light sources and reflected by said reflecting plate excite said fluorescent powder layer to radiate high-brightness visible lights.

2. The flat lamp structure as claimed in claim 1, wherein each of said UV light sources is partly placed in said reflecting plate and partly placed in said macromolecular polymer layer.

3. The flat lamp structure as claimed in claim 1, wherein each of said UV light sources is completely placed in said macromolecular polymer layer.

4. The flat lamp structure as claimed in claim 1, wherein said reflecting plate is a reflecting plate capable of reflecting UV lights.

5. The flat lamp structure as claimed in claim 1, wherein said UV light sources are UV lamp tubes.

6. The flat lamp structure as claimed in claim 1, wherein said UV light sources are UV light-emitting diodes.

7. A high-brightness flat lamp structure having a reflecting plate, a plurality of UV light sources and a mixed layer of macromolecular polymer and fluorescent powder, said UV light sources being sandwiched between said reflecting plate and said mixed layer of macromolecular polymer and fluorescent powder, the functions of diffusing and guiding light of macromolecular polymer being exploited to let UV lights emitted by said UV light sources and reflected by said reflecting plate excite fluorescent powder to radiate high-brightness visible lights.

8. The flat lamp structure as claimed in claim 7, wherein each of said UV light sources is partly placed in said reflecting plate and partly placed in said mixed layer of macromolecular polymer and fluorescent powder.

9. The flat lamp structure as claimed in claim 7, wherein each of said UV light sources is completely placed in said mixed layer of macromolecular polymer and fluorescent powder.

10. The flat lamp structure as claimed in claim 7, wherein said reflecting plate is a reflecting plate capable of reflecting UV lights.

11. The flat lamp structure as claimed in claim 7, wherein said UV light sources are UV lamp tubes.

12. The flat lamp structure as claimed in claim 7, wherein said UV light sources are UV light-emitting diodes.

* * * * *